United States Patent [19]

Trikilis

[11] Patent Number: 4,989,368

[45] Date of Patent: Feb. 5, 1991

[54] TURNSTILE ASSEMBLY

[76] Inventor: Emmanuel M. Trikilis, 1545 W. 130th St., Brunswick, Ohio 44212

[21] Appl. No.: 397,050

[22] Filed: Aug. 22, 1989

[51] Int. Cl.[5] ..... E05D 15/02

[52] U.S. Cl. ..... 49/42; 49/46; 192/81 C; 403/323

[58] Field of Search ..... 49/42, 43, 44, 46, 47, 49/45; 188/82.6; 192/415, 81 C, 26; 403/323; 256/65

[56] References Cited

U.S. PATENT DOCUMENTS

| | | | |
|---|---|---|---|
| 1,022,684 | 4/1912 | Kleinbaum . | |
| 1,655,501 | 1/1928 | Hedley et al. | 49/46 |
| 1,658,264 | 2/1928 | Sutton et al. | 403/378 X |
| 1,791,922 | 2/1931 | Distler et al. | 49/46 |
| 1,914,237 | 6/1933 | Blanchard | 49/44 |
| 1,933,725 | 11/1933 | Frankford | 49/47 X |
| 2,393,068 | 1/1946 | Sexton | 188/163 X |
| 2,823,325 | 2/1958 | Stephan | 188/163 X |
| 3,339,681 | 9/1967 | Holladay | 188/163 |
| 3,397,486 | 8/1968 | Foxwell et al. | 49/47 |
| 3,839,825 | 10/1974 | Nica | 49/42 X |
| 3,886,684 | 6/1975 | Sheckells | 49/44 |
| 3,978,613 | 9/1976 | Hayward et al. | 49/46 |
| 4,020,927 | 5/1977 | Collins | 49/46 X |
| 4,159,048 | 6/1979 | Baxter et al. | 192/415 |
| 4,321,992 | 3/1982 | Gallo | 192/81 C |
| 4,358,909 | 11/1982 | Trikilis | 49/42 |
| 4,701,074 | 10/1987 | Hall | 403/323 X |
| 4,801,257 | 1/1989 | Lenk | 403/323 X |

*Primary Examiner*—Philip C. Kannan

*Attorney, Agent, or Firm*—Fay, Sharpe, Beall, Fagan, Minnich & McKee

[57] ABSTRACT

A revolving door includes an elongated pivot column having a plurality of integrally formed first grooves extending longitudinally therealong at equidistantly spaced intervals therearound. A plurality of barrier members are provided. At least one of the members is associated with each first groove and arranged to extend radially outward of the groove. A locking device is concealably contained and interposed between the side wall of each first groove and a terminal end of each barrier member mountingly associated with the groove for retaining the barrier member in the groove. The locking member includes a second groove which extends longitudinally along the side wall of each first groove and a rigid locking bar extending into the second groove. The locking bar has a round side and a flat side and is selectively rotatable to wedging engage a wall of the second groove and the terminal end of each barrier member.

28 Claims, 7 Drawing Sheets

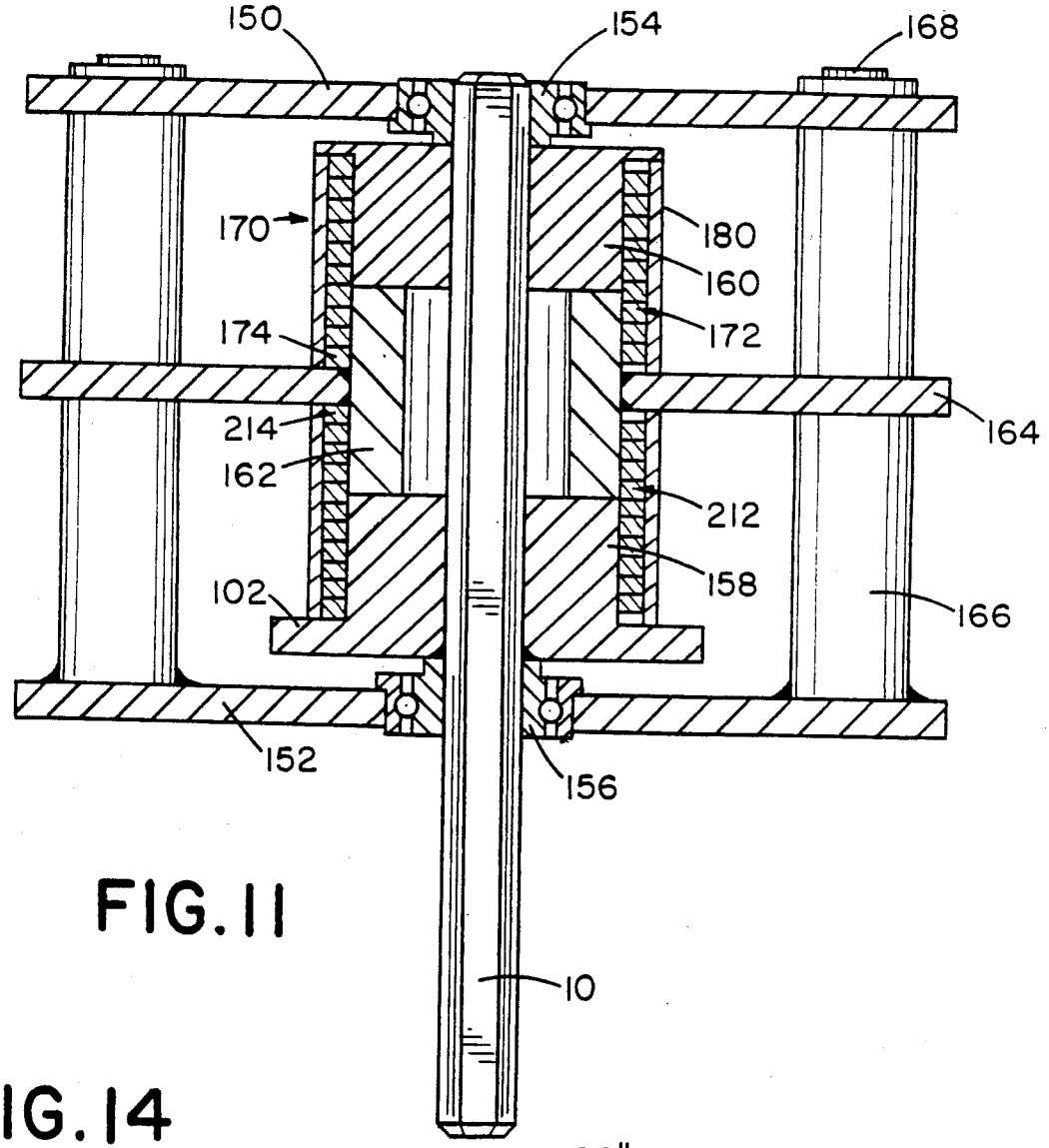
FIG. 11
FIG. 14
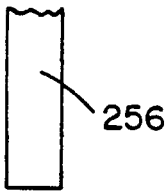
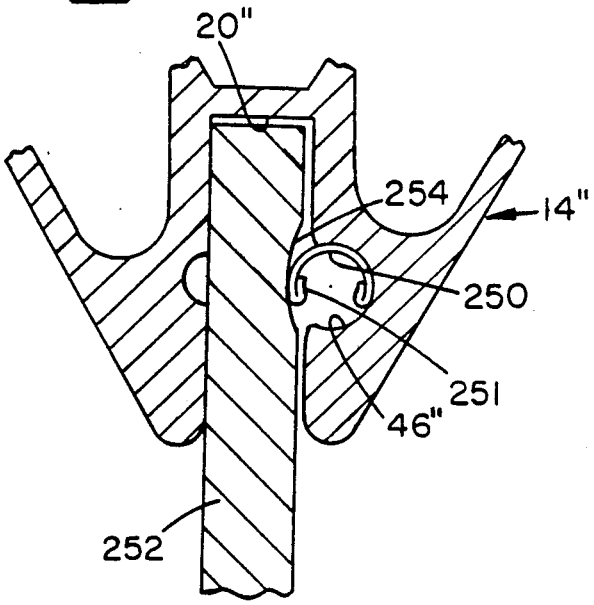
FIG. 13

TURNSTILE ASSEMBLY

BACKGROUND OF THE INVENTION

This invention pertains to the art of personnel monitoring or control systems. More particularly, the present invention relates to rotary gate devices which facilitate controlled passage between two separated areas.

The invention is particularly applicable to a turnstile for use in controlling and/or monitoring the passage of personnel between two distinct areas, such as at entrances and exits into and out of various buildings or facilities. However, it will be appreciated by those skilled in the art that the invention can be readily adapted for use in other rotary gate environments, such as revolving doors and the like.

Conventionally known turnstiles have generally comprised cage-like structures having enclosure walls which have typically been defined by arcuate sheet members or an assembly of intersecting vertical and horizontal members disposed in an arcuately shaped pattern. Prior turnstiles have also included rotor constructions including vertically disposed pivot columns having vertically aligned rows of barrier arms extending radially outward from the columns. The spacing of adjacent rows of arms was sufficient for a person to pass through the turnstile as the rotor is rotated. It has been found, however, that defects in these constructions are such that the rotor's value is impaired.

One problem has been the number of separate or individual component parts utilized for the manufacture of the turnstile which has caused inventory, manufacturing and assembly difficulties. Another problem with preassembled constructions is that they are heavy, awkward, and costly to ship and install. Further, prior constructions were time consuming to install since they included numerous nuts, bolts, or rivets which needed to be affixed to the pivot column or the mounting columns. Additionally, if one of the barrier arms was broken in the conventional turnstile, it was difficult and time consuming to replace that barrier arm.

It would be advantageous to provide a locking system for the barrier arms which would prevent any play of the arms when someone attempted to pull out a barrier arm from the pivot column. However, it would be advantageous to allow the barrier arms to be selectively removed from the pivot column for purposes of replacement, repair, or the like.

Still other problems encountered with prior turnstile constructions have centered on the rotor control mechanisms, which have not been particularly reliable nor have they provided the degree of flexibility in operation to accommodate the various desired rotor operational modes.

One common limitation in conventional turnstiles is that when any pressure is exerted against a barrier arm, the turnstile will not unlock. In heavy traffic situations, particularly in the transit industry, this plays havoc with trying to move people efficiently and safely at the greatest speed. With everyone pushing, it is difficult for anyone to back up in order to disengage the locking mechanism.

Another problem turnstile manufacturers have always had is the need to fabricate and assemble their products in the plant so that they are shipped to the site of use in one piece. There is a weight and bulk problem inherent in such a practice, which adds considerably to the cost of the turnstile. Another problem is that skill is required to assemble the turnstiles and this cannot be done by untrained laborers.

If the turnstiles could be shipped and stored in parts, the size of the shipping crate would be reduced greatly and the weight of the crate would also be reduced, resulting in a smaller shipping fee. In addition, more room would be available at the manufacturing plant to store the finished product and at the shipper to ship the product since each turnstile would take much less room. Thus, the product could be stacked much higher than previously when entire turnstiles had to be assembled at the manufacturing plant.

The present invention contemplates a new and improved apparatus which overcomes all of the above referenced problems and others and provides a new rotary gate construction which is simple in design, economical to manufacture, light in weight, and of considerable strength, easy to assemble and install on site, reliable for a range of operational modes and readily adapted to a variety of applications.

BRIEF SUMMARY OF THE INVENTION

In accordance with the present invention, a new and improved revolving door construction is provided.

More particularly in accordance with the invention, the door construction comprises an elongated pivot column including a plurality of integrally formed first grooves extending longitudinally therealong at equidistantly spaced intervals therearound. A plurality of barrier members are provided with at least one of the members being associated with each first groove such that the members are arranged to extend radially outward of the groove. A locking means is concealably contained and interposed between a side wall of each first groove and a terminal end of each barrier member mountingly associated therewith for retaining the barrier member in the groove. The locking means comprises a second groove which extends longitudinally along the side wall of the first groove. A locking bar extends in the second groove. The locking bar has a round side and a flat side and is selectively rotatable to wedgingly engage both a wall of the second groove and the terminal end of each barrier member.

In accordance with another aspect of the invention, a turnstile construction is provided to facilitate selective passage between two separated areas.

More particularly in accordance with this aspect of the invention, the turnstile construction comprises a plurality of elongated upstanding mounting columns spaced apart from each other to define a frame like structure at some predetermined location between the areas. A closure means extends between at least one pair of the mounting columns. An elongated upstanding pivot column is spaced from the pair of mounting columns and journaled for selective rotation about its longitudinal axis. The pivot column has a plurality of longitudinal grooves disposed at spaced intervals therearound. A plurality of pivot column arms are associated with each pivot column groove and are arranged to extend radially outward of the pivot column. Those column arms associated with each groove are spaced apart from each other in a generally aligned relationship with each other over at least a portion of the groove length. A locking means is received in each groove in a cooperative locking relationship with one end of the associated column arms. The locking means comprises an elongated locking member extending longitudinally in each of the longitudinal grooves. The locking member has a flat side and a round side and is selectively rotatable to wedgingly engage both a wall of the longitudinal groove and each of the associated column arms.

In accordance with still another aspect of the invention, a rotary gate control assembly is provided.

More particularly in accordance with this aspect of the invention, the control assembly comprises a pivot rod on which the rotary gate is adapted to rotate, a first hub section secured to the pivot rod and a first spring clutch assembly encircling the first hub section for controlling rotation of the rod. A first solenoid actuating mechanism is operatively connected to the first spring clutch assembly for selectively actuating same.

One advantage of the present invention is the provision of a new rotary gate constructed from a minimum number of different light weight extruded components.

Another advantage of the present invention is the provision of a rotary gate such as a turnstile having a concealed means for interconnecting the turnstile components.

Still another advantage of the present invention is the provision of a turnstile which can be assembled on site instead of having to be shipped in an assembled condition.

Yet another advantage of the present invention is the provision of a rotary gate assembly in which the arms or panels of the gate can be selectively detached from a pivot column simply by rotation of a locking member.

A further advantage of the present invention is the provision of a means for rotating a locking bar or pin in order to selectively secure rotor arms or panels in place in a rotary gate such as a turnstile or a revolving door.

A still further advantage of the present invention is the provision of a new control mechanism which provides selective control of the rotation of a rotary gate, such as a turnstile or a revolving door, in either direction.

Other benefits and advantages of the subject new rotary gate assembly will become apparent to those skilled in the art upon a reading and understanding of this specification.

BRIEF DESCRIPTION OF THE DRAWINGS

The invention may take physical form in certain parts and arrangements of parts, the preferred and alternate embodiments of which will be described in this specification and illustrated in the accompanying drawings which form a part hereof and wherein:

FIG. 11 is a cross sectional view of the rotor control mechanism of FIG. 10 along line 11—11;

FIG. 13 is a fragmentary cross sectional view of a locking pin utilized with a turnstile rotor and its arms according to an alternate embodiment of the present invention; and, FIG. 14 is a fragmentary side elevational view of a tool for rotating the locking pin of FIG. 13.

DETAILED DESCRIPTION OF THE PREFERRED AND ALTERNATE EMBODIMENTS

Figure 1:
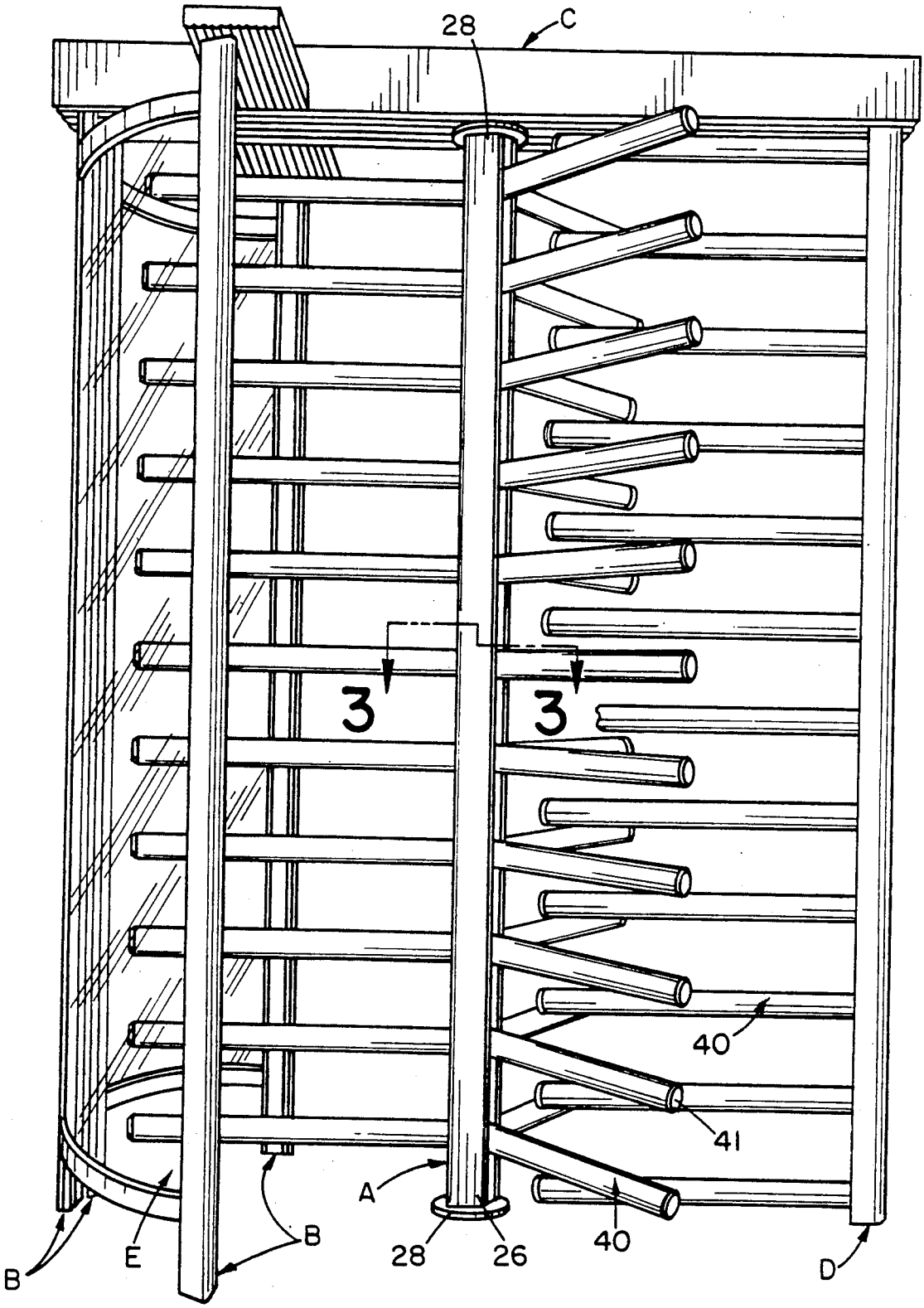
FIG. 1 is a perspective view of a turnstile constructed in accordance with the present invention.
Figure 2:
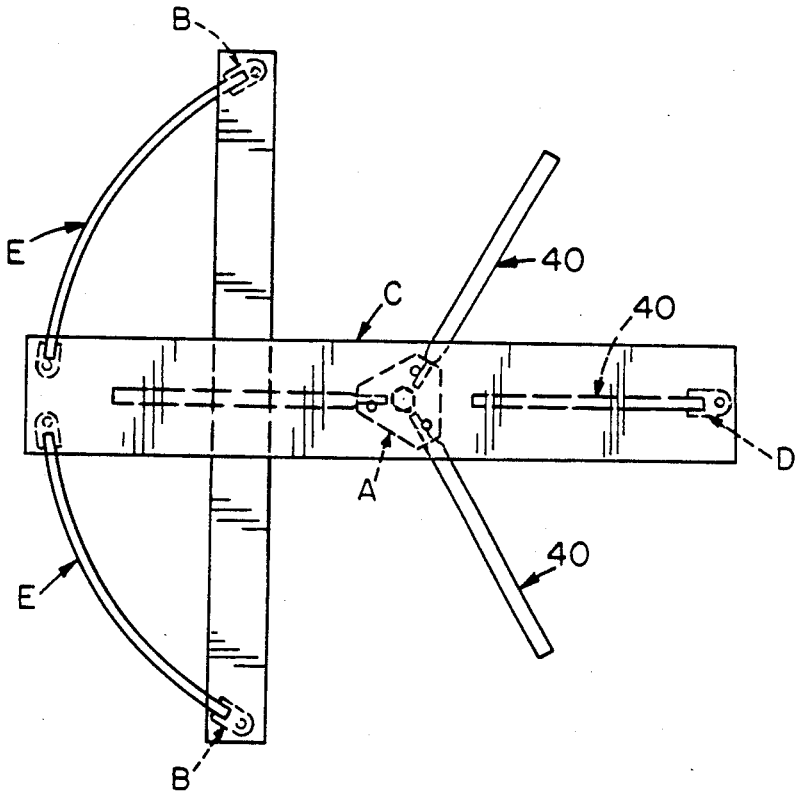
FIG. 2 is a reduced top plan view of the turnstile of FIG. 1.

Referring now to the drawings wherein the showings are for purposes of illustrating the preferred and alternate embodiments of the invention only and not for purposes of limiting same, FIG. 1 shows a turnstile construction comprising a turnstile rotor A, a plurality of mounting columns B, an overhead support frame C, to which the rotor and the mounting columns are secured together with a barrier column D and a pair of cage panels E (as best shown in FIG. 2) which are secured to the mounting columns B. While the rotary gate construction of the present invention is primarily designed for and will hereinafter be described in connection with a specific type of turnstile installation, it will be appreciated that the overall inventive concept involved could be adapted for use in other many entry and exit control mechanisms, including the revolving door illustrated in FIG. 7.

Figure 3:
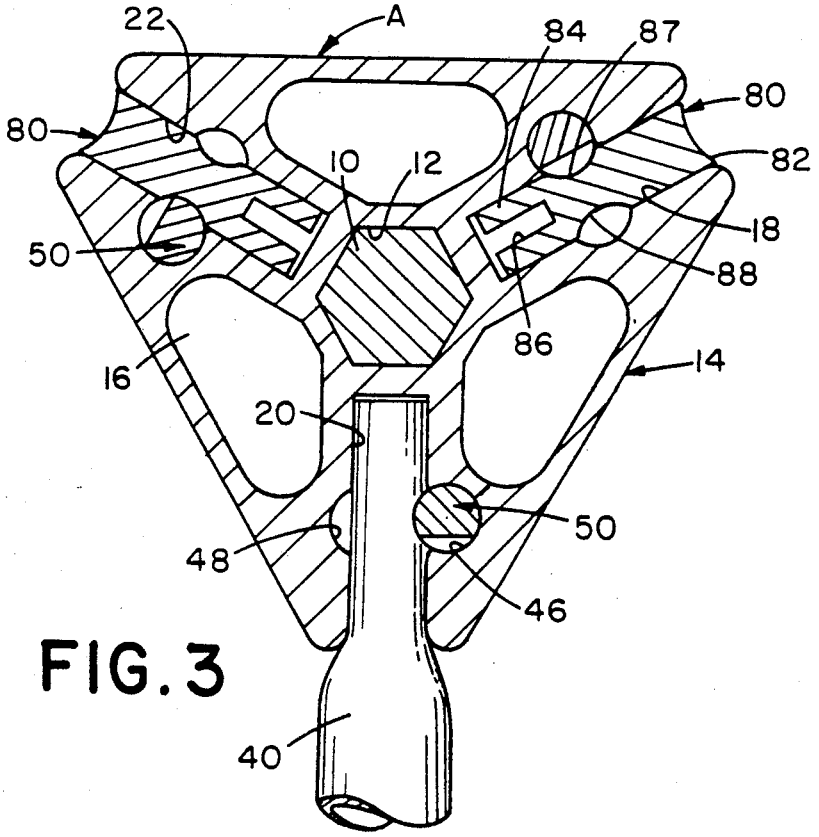
FIG. 3 is an enlarged cross sectional view taken along line 3—3 of FIG. 1.

More specifically, and with reference now to also FIG. 3, the turnstile rotor A includes a hexagonally-shaped pivot rod 10 which is located in a hexagonally-shaped aperture 12 of a pivot column 14. The column 14 includes hollowed out areas 16 in order to reduce its weight. Also provided in the column 14 are first, second, and third grooves, 18, 20, and 22, which extend into the column at spaced 120° intervals. As shown, the column 14 has a somewhat triangular transverse cross section with the grooves 18, 20, and 22 being equidistantly spaced apart at the vertices of the triangle. The configuration shown is aesthetically pleasing for the overall turnstile construction while minimizing the amount of material utilized and providing a strong supporting element. However, it should be recognized that other geometric structures for the column could also be utilized.

Preferably, the pivot column 14 is comprised of an elongated member extruded from aluminum or a like material. The first, second, and third grooves 18, 20 and 22 may be integrally formed with the pivot column at the time of extrusion to eliminate subsequent machining steps. The column is also preferably extruded with the hollowed out areas 16 as well as the central aperture 12. The pivot column 14 is journaled for selective rotation about its longitudinal axis. To that end, and in the preferred construction illustrated in FIG. 1, a pivot column base end 26 is mounted upon a suitable bearing 28, such as a polymeric cone bearing, and a pivot column upper end portion 28 is mounted in the overhead support frame C. The lower bearing 28 can be of a suitable conventional construction such as a male and female construction in which the male part is fixedly secured to the surface or floor area upon which the turnstile rests with the female part journally receiving the male part. In this way, the weight of rotor A is primarily borne by the surface or floor area through the male part. Of course, other mounting arrangements could also be satisfactorily employed as desired.

Secured in each of the grooves 18, 20, and 22 are a plurality of identical turnstile arms 40 extending radially outwardly therefrom. The turnstile arms 40 are aligned in generally vertically disposed rows for defining a plurality of barrier planes.

Figure 6:
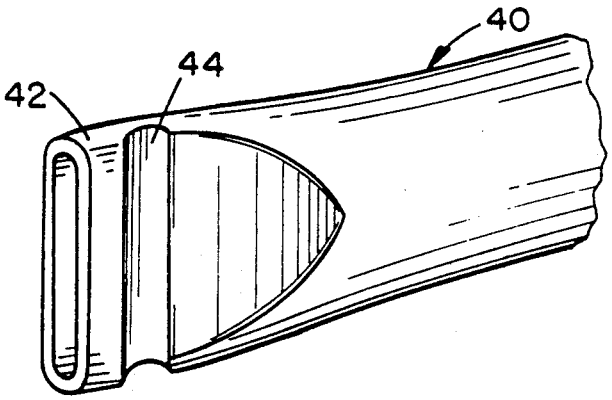
FIG. 6 is a greatly enlarged perspective view of an inner end portion of a turnstile arm of the turnstile construction of FIG. 3.

With reference now also to FIG. 6, it can be seen that each turnstile arm 40 is hollow and has a generally elliptical or oval transverse cross section. The outer end of each arm, i.e. that end which is not received and mounted in the grooves 18, 20, and 22 can be conveniently sealed with a suitable conventional plastic cap or the like 41 (as shown in FIG. 1). An inner end 42 of each arm 40, which is adapted to be received in one of the pivot column grooves, such as groove 20 illustrated in FIG. 3, is pressed or otherwise formed into a highly elliptical shape. Moreover, the arm inner end 42 is provided with a trough portion 44. The pivot column portion adjacent the groove 20 is also provided with a pair of spaced troughs 46 and 48. The first column trough 46 adjoins the arm trough 44 in order to hold form a circular bore which accommodates a locking bar 50 therein.

Figure 4:
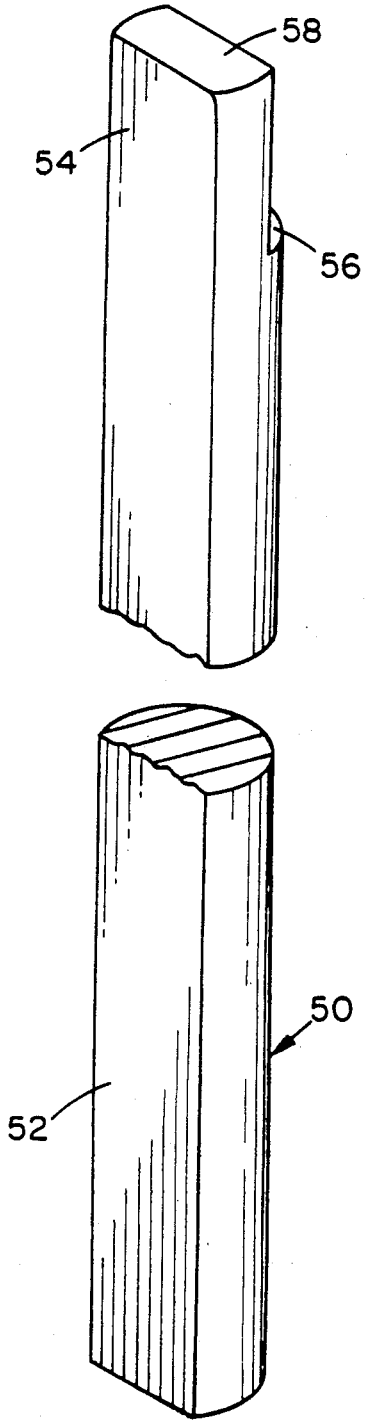
FIG. 4 is a greatly enlarged broken-away perspective view of a locking bar of the turnstile construction of FIG. 3.

With reference now also to FIG. 4, the locking bar 50 is an elongated member which includes a flat face 52 and, on an upper end 54 thereof, a slotted section 56 which defines an arm 58.

Figure 5:
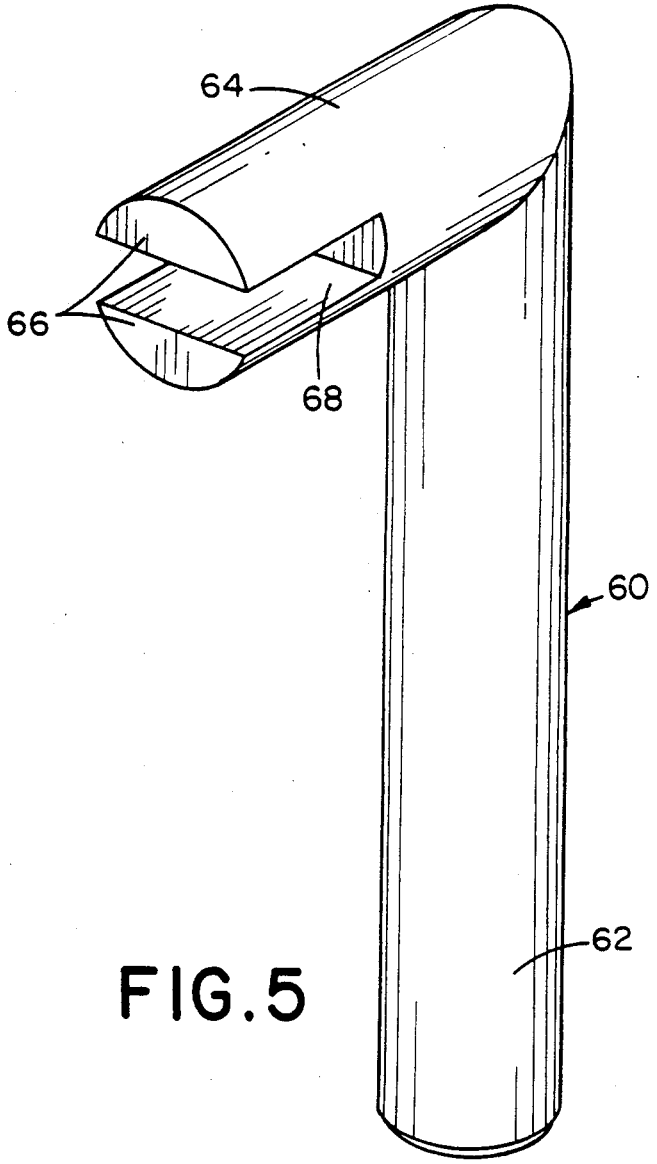
FIG. 5 is a perspective view of a wrench-like tool for rotating the locking bar of FIG. 4.

Adapted to rotate the locking bar 50 is a wrench-like tool 60 as illustrated in FIG. 5. The tool 60 includes a handle portion 62, as well as a head portion 64. The head is provided with a pair of spaced jaws 66 which define between them a slot 68 that is so sized as to accept the arm 58 of the locking bar therein. In this way, through the use of the wrench-like tool 60, the locking bar 50 can be rotated around its longitudinal axis in the circular bore formed by the first column trough 46 and the arm trough 44.

In its open position, the locking bar allows the entry of the barrier arms or turnstile arms 40 into the pivot column grooves. Then by simply twisting or rotating the rod 50 in a counter-clockwise direction, the rod enters the arm trough 44 and wedges itself against the barrier arm tightly so that no "play" is possible. Also, the more one attempts to pull out the barrier arm, the more it tightens itself within the column. This will make it more difficult to yank out the barrier arm in question. However, if replacement of the arm is ever necessary, the use of the wrench-like tool 60 will enable a rotation of the locking bar 50 and a subsequent removal of any particular barrier arm 40 that may need to be replaced for any reason.

Another embodiment of a locking bar is illustrated in FIG. 13 and described hereinafter together with a tool illustrated in FIG. 14.

With reference again to FIG. 1, it can be seen that the barrier column D is also provided with a plurality of arms 40. These arms are secured to the column in the same way as the arms which are affixed to the pivot column 14. The foregoing relationships facilitate identical mounting of the barrier arms 40 to the pivot column 14 as well as the barrier column D.

Arm spacers 80 are preferably provided between the several barrier arms 40, as best illustrated in FIG. 3. These spacers have length dimensions calculated so that the turnstile arms will be laterally spaced apart relative to each other in a suitable fashion. Each arm spacer 80 includes a first or outer end 82 and a second or inner end 84 which can be provided with a channel 86 therein, as well as spaced troughs 87 and 88.

The arm spacers 80 are received in the pivot column grooves 18, 20, and 22, as well as a suitable channel (not illustrated) formed in the barrier column D. The spacers 80 are secured in the grooves with the same locking bar 50 which secures the barrier arms 40 in place.

Suitable arm and end spacers are provided in the pivot column grooves and the barrier column groove so that the pivot column arms and barrier column arms will be laterally spaced apart relative to each other for allowing free passage of the pivot column arms between the barrier column arms when the pivot column 14 is itself rotated about its longitudinal axis during turnstile operation.

Figure 8:
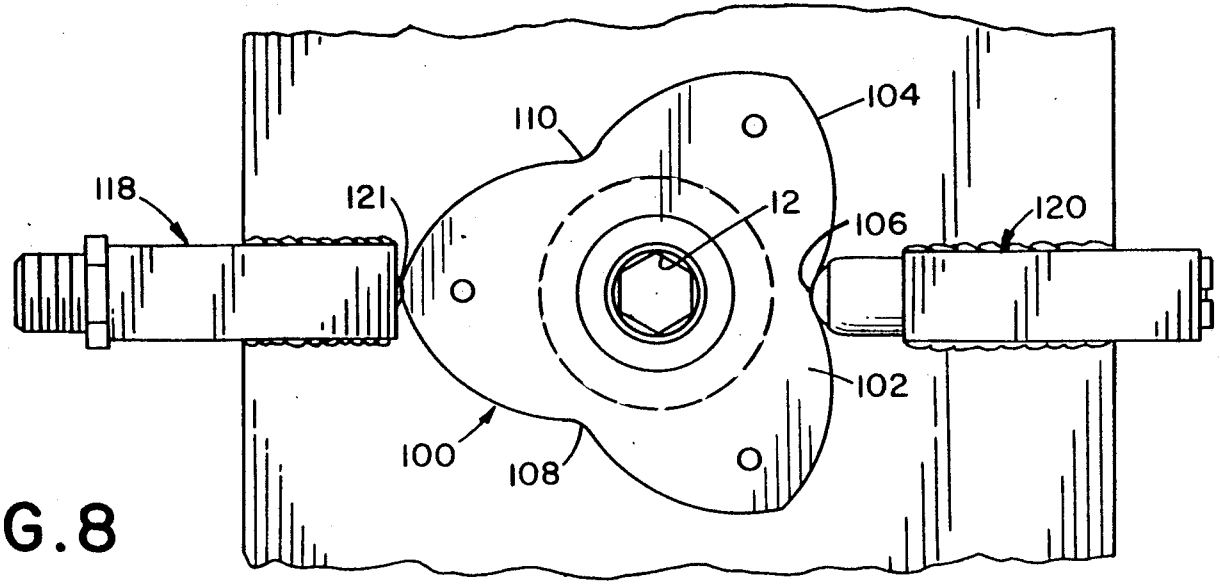
FIG. 8 is a top plan view of a part of a turnstile cam mechanism and its associated structure according to the present invention.
Figure 10:
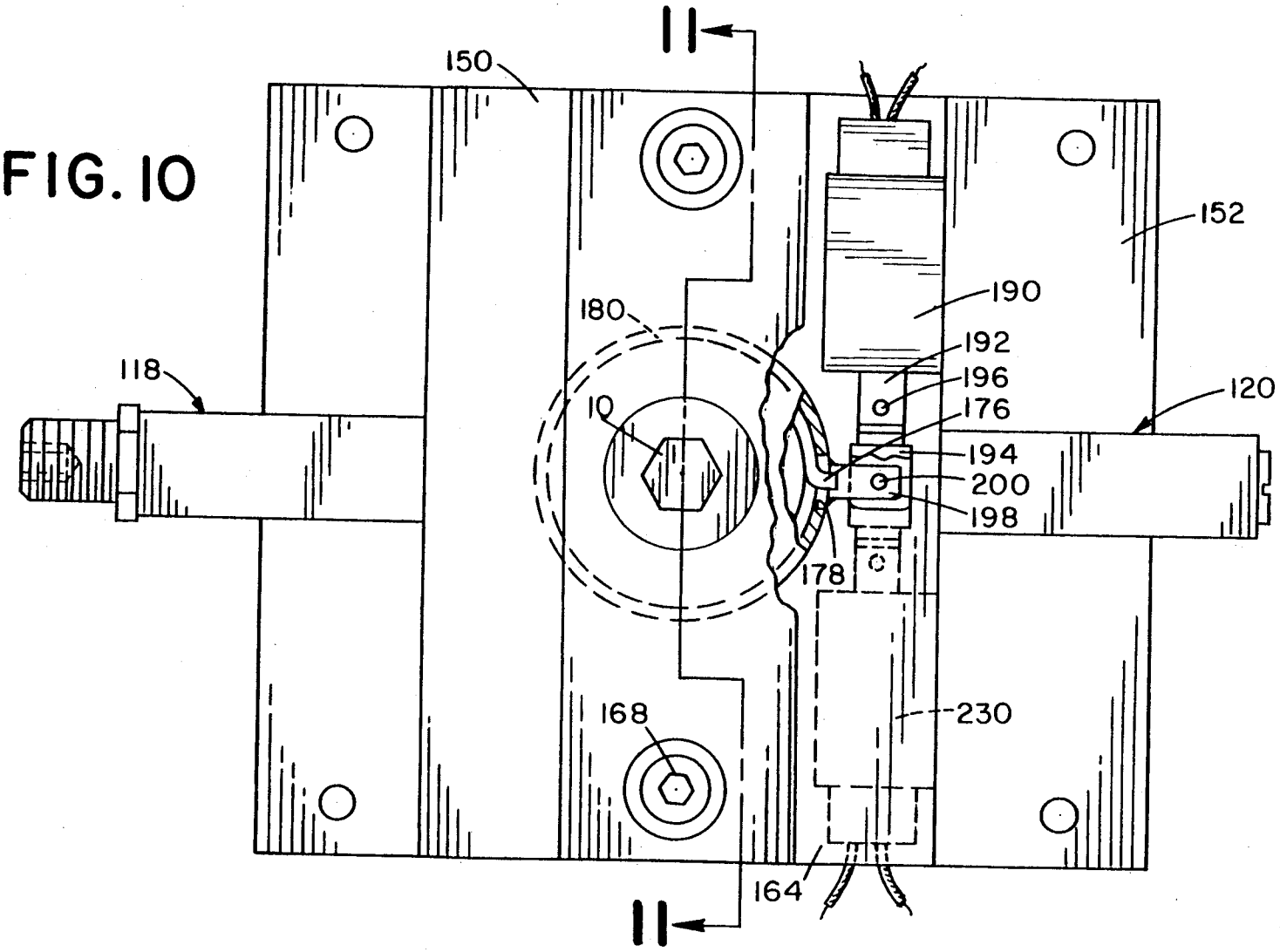
FIG. 10 is a top plan view, partially broken away, of a turnstile rotor control mechanism which incorporates the cam mechanism of FIG. 8 according to the present invention.

With reference now to FIG. 8, a control mechanism 100 for the turnstile includes a cam 102 having an outer cam surface 104 which includes, in the three lobe cam configuration shown, first, second, and third detents 106, 108, 110.

Also provided are a shock absorber 118 and a cam follower 120 which are spaced apart, preferably along the same axis, on either side of the cam 102. The shock absorber 118 is conventional and simply includes a ball 121 urged towards the cam 102 by a spring (not visible).

Figure 9:
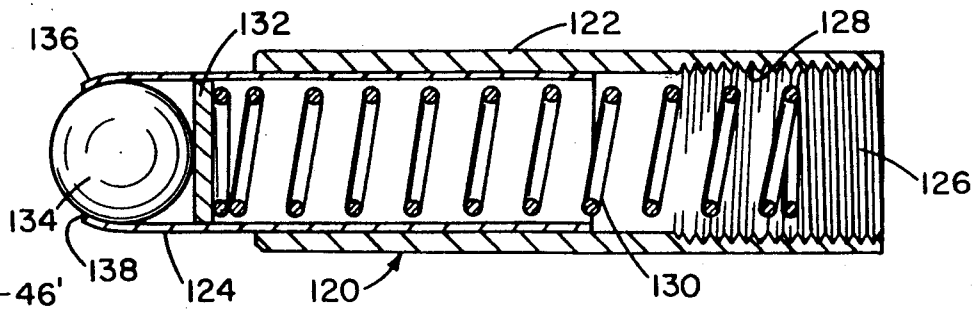
FIG. 9 is a greatly enlarged cross sectional view of a cam follower of the mechanism of FIG. 8.

With reference now also to FIG. 9, the cam follower 120 includes an outer housing 122 as well as an inner housing 124 which is slidable in the outer housing. A set screw 126 closes an open end of the outer housing and cooperates with a threaded end 128 thereof. A compression spring 130 is held within the outer housing and extends also within the inner housing to a disk 132 which is slidably positioned in the inner housing. A ball 134 rests against a front face of the disk 132. The ball is in turn held in place in a front end 136 of the inner housing by curved lips 138 provided on the inner housing.

The spring biased cam follower is used to exert pressure against the cam in order to assist the user in the use of the turnstile. The shock absorber 118 on the other side of the cam is used for the purpose of preventing the turnstile from swinging with any great force as may be exerted by users deliberately or accidentally pushing on the turnstile with force. This softens the return of the turnstile barrier to its final rest position.

Whereas a three lobe cam 102 is illustrated in FIG. 8, for a three vaned door or turnstile, it should be appreciated that a four lobe cam may be used for a four vaned door or turnstile and that the same principle of operation applies. The only difference between the two and four lobe system is that the two lobe cam would enable the door to move 180° from one rest/lock condition to the next rest/lock condition, whereas the four lobe cam can be used in two different ways. The four lobe cam can be used either as a pause between the movement from one 180° rotation to the next, or as a means for using it as a so-called man-trap. That is, the cam could lock at the 90° position to entrap anyone trying to enter without authorization. However, that function could, in fact, also be performed electronically without a four lobe cam by using relays and switches from one position to the next.

As mentioned, it has conventionally been required that all barrier arms and spacers be secured in place in both the pivot column as well as the barrier mounting column before a turnstile is shipped by a manufacturer. This not only takes the manufacturer a considerable amount of time but also one ends up with a pivot column whose diameter is a minimum of about four and a half feet. Accordingly, the shipping crate needed to accommodate one pivot column takes up considerable space. The end result is a shipping package, conventionally made of two by four wood boards covered with, e.g., plywood, which measures eight feet in length and five feet square, thereby taking up considerable storage room and adding to the cost of shipping by freight. Also, it has been estimated that just the packing of the turnstile into a shipping crate takes from four to six hours.

The present invention, on the other hand, does away with all of these disadvantages since the personnel at the factory no longer have to assemble the pivot column. Rather, only the spacers need to be inserted in the pivot column and locked in place. Then the pivot column can be placed in a suitable paper or cardboard box with all the arms thereof packed flat alongside the pivot column. In this way, a shipping crate need only be three feet wide and 20 inches high and 86 inches in length. Also, the weight has been cut by approximately 25% from about 650 pounds to about 460 pounds since all the wood reinforcing material has been eliminated. Finally, the labor of assembling the pivot column has been eliminated and this is estimated to amount to approximately $500.00. In addition, considerably more room is available both at the plant to store the finished product and to the shipper, who can now take dozens of systems in the same space that previously was occupied by just a few systems. This reduces the estimated cost of shipping considerably from approximately $100.00 to less than $15.00.

Another advantage of the pivotable locking bars 50 is that in the event that any of the arms 40 need to be replaced because of vandalism or any other reason, it will only take a few minutes to replace the damaged or missing arms with new ones instead of having to disassemble the entire turnstile in order to replace the broken arms. Whereas previously it would take three men a day or more to disassemble a turnstile, now, with the locking bar 50 of the present invention and the wrench-like tool 60, it will only take one man a few minutes to replace a broken arm. In this way, a conventional barrier arm, that may be made of aluminum or steel, can be replaced for specific purposes with a wood-plastic composition or a glass arm, or a combination thereof as is required for a particular purpose.

Figure 7:
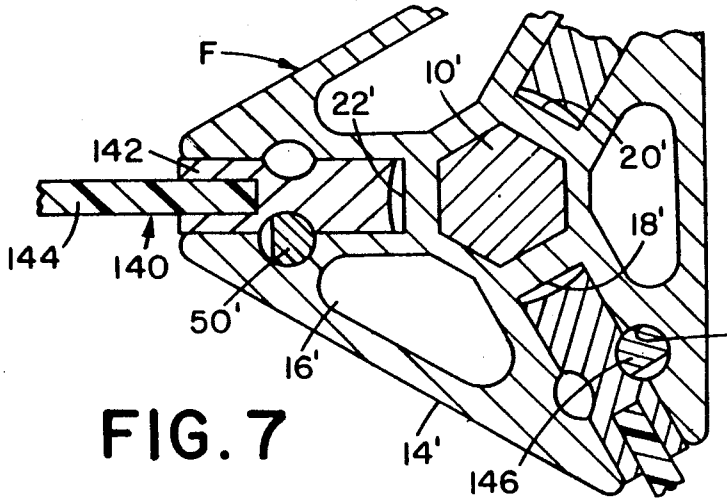
FIG. 7 is a top plan view in cross section, and partially broken away, of a revolving door according to a second preferred embodiment of the present invention.

With reference now also to FIG. 7, the use of the fastening system illustrated in FIGS. 3–5 is here shown in connection with a rotary gate having the form of a revolving door F instead of a turnstile. For ease of understanding of this embodiment like components are identified by like numerals with a primed (') suffix and new components are identified by new numerals.

The door F includes a pivot column 14' in which is disposed a pivot rod 10'. The column has a plurality of hollowed out areas 16', as well as first, second, and third grooves 18', 20', and 22'. Disposed within each of the grooves is a door panel 140 which has a frame section 142 encasing a window section 144. Disposed in the frame section is at least a first frame trough 146 which is adapted to cooperate with a first column trough 46' so as to be able to accommodate a locking bar 50'. As in the embodiment of FIG. 3, the bar can be of the variety illustrated in FIG. 4, and adapted to be rotated by a wrench-like tool, such as is illustrated in FIG. 5.

As with the embodiment of FIGS. 1–6, the panels 140 in FIG. 7 can be selectively removed from the pivot column 14– in order to allow replacement thereof as necessary and also in order to allow easier and less expensive shipping of the revolving door from the site of manufacture to the site of installation.

Located in the overhead support frame C is the mechanism which allows selective actuation of the turnstile. With reference now to FIG. 11, this mechanism comprises an upper mounting plate 150 and a lower mounting plate 152 as well as an upper bearing 154 and a lower or mounting bearing 156. Rotating in the two bearings is the hex-shaped shaft 10 which has secured thereto, in spaced relation, a lower hub section 158 and an upper hub section 160. Located between the two hub sections is a cylindrical member 162. Secured to the cylindrical member 162 is a plate 164 which extends substantially normal to the member 162. A pair of mounting cylinders 166 extend through spaced apertures in the plate and serve to secure the top bearing plate 150 to the lower or mounting plate 152. For this purpose, the two cylinders are each secured, such as by the welds illustrated, to the lower plate 152 and have fasteners 168 extending thereinto to secure the two plates together.

In order to control the rotation of the hex-shaft 10, a spring clutch assembly 170 is provided. This allows control of the shaft rotation in one direction. However two such mechanisms can be provided, if desired, so that control in both directions of rotation can be exercised.

Figure 12:
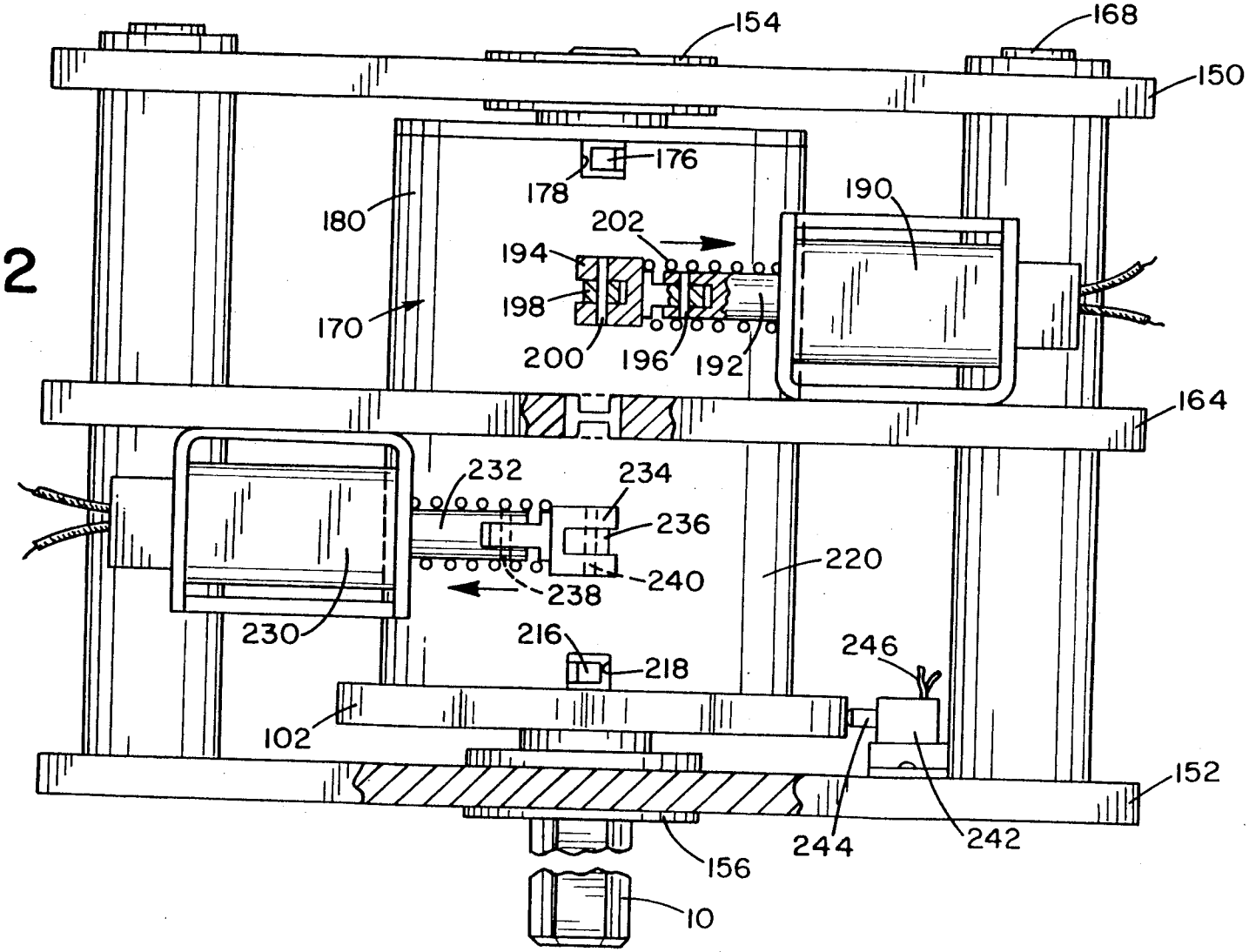
FIG. 12 is an enlarged side elevational view of the rotor control mechanism of FIG. 10.

The spring clutch assembly 170 comprises a spring member 172 having a first end 174 which is secured to the plate 164 such as by welding. A second end 176 of the spring 172 extends through a slot 178 in a release sleeve 180 as is best seen in FIG. 12. Controlling the rotation of the release sleeve 180 is a solenoid 190 which has a first arm 192 extending away therefrom. The arm 192 is connected to a second arm 194 by a pin 196. A collar arm 198 extends normal from the collar or sleeve 180 and is fastened by a pin 200 to the second solenoid arm 194. In this way, actuation of the solenoid 190 will rotate the sleeve or collar 180. In order to bias the solenoid arms towards an extended position, a spring 202 is positioned around the first solenoid arm 192. The action of this spring is overcome by the actuation of the solenoid to pull the first solenoid arm 196 back against the pressure of the spring and thereby rotate the collar or sleeve 180. Rotation of the sleeve will also rotate the hub encircling spring 172 since the second end 176 thereof moves when the collar 180 is rotated.

The spring 172 is wrap spring, which has a diameter that is slightly smaller than the diameter of the hub 160 and the cylindrical section 162. Therefore, the spring will tightly engage the hub 160 and cylindrical section 162 to prevent the hex-shaft 10 from turning, which also prevents the turnstile rotor A from rotating. The spring 172 is wound as a left hand spring. When engaged, the solenoid 190 will rotate the release sleeve 180 thereby also rotating the spring 172 as mentioned. This will enlarge the diameter of the spring in order to disengage the spring from the hub 160 thereby allowing the hub to rotate, hence, allowing the hex-shaft 10 and the entire turnstile rotor A to rotate. When disengaged, the solenoid will return to its extended position as urged by the spring 202 thereby again returning the release sleeve 182 to its normal position. This will rewrap the spring 172 around the hub 160 thereby again locking the turnstile rotor and preventing any rotation thereof.

It should be appreciated, however, that another way of operating the turnstile rotor would be as a fail-safe rotor in which when the solenoids are de-energized, the wrap spring clutches will be unlocked instead of locked, as in the embodiment illustrated. In this type of embodiment, the spring clutch assembly 170 would have a wrapping spring, which would be slightly larger in diameter than the hub, thereby allowing the hub to rotate freely unless the spring was tightened around the hub by the actuation of the solenoid and the rotation of the release sleeve.

Yet another option would be the provision of a manual key lock feature (not illustrated) which would allow a selective disabling of the solenoid system and therefore a selective rotation of the turnstile rotor A. In the embodiment illustrated, however, the spring normally wraps around the hub section 160 as well as the cylindrical section 162 in tight engagement, thus locking the turnstile and preventing the rotation of the hex-shaft 10. Engaging the solenoid will unwrap the spring, thereby allowing the turnstile to rotate.

The spring 172 controls the selective rotation of the turnstile only in one direction. If control of the turnstile's rotation in the other direction is desired, a second spring 212 can be provided, as is illustrated in FIG. 11. This spring, which operates in the same manner as the first spring 172, similarly has a first end 214 which is secured to the plate 164, such as by welding, and a second end 216 which extends out a slot 218 in a second release sleeve 220. A second solenoid 230 controls the actuation of the second spring 212 through a suitable set of solenoid arms 232 and 234 and a cooperating collar arm 236. As in the first embodiment, the arms are secured to each other by suitable pins 238 and 240. The lower spring will control the rotation of the hex-shaft 10 in a second direction. In this way, control of rotation of the hex-shaft in either direction is solenoid operated.

In a normal rest or lock condition, the clutch/brake spring 212 encircling the hub 158 of the hex-shaped pivot rod 10 is taut and there can be no movement by the pivot column 14. One end of the spring is operatively connected to the solenoid 230 which responds on impulse from the electronics telling it to release. The solenoid thus releases, thereby removing the tautness against the clutch/brake which then enables the pivot rod 10, and hence the pivot column 14, to move.

Preferably, a switch 242 is provided on the lower plate 152 adjacent the cam 102. The switch includes a sensing finger 244 which is selectively contacts a cam lobe. When such contact is achieved, the switch 242 sends an electrical signal through wires 246 to a suitable conventional control circuit (not illustrated) which then will deactivate the one or more solenoids 190 and 230 thereby preventing any further rotation of the turnstile. If desired, the switch can be a Hall effect type switch. It should be noted that the electronic circuitry which controls the actuation of the solenoids 190 and 230 and is connected to the switch 242 can be interfaced with a mini-computer or the like as well as with photo scanners and similar control mechanisms and sensors.

A bidirectional control system could be provided which could be utilized in both a clockwise and a counter clockwise direction. Such a system would be controlled by impulses from conventional electronics as may be required for any function. However, in the embodiment of the invention illustrated in the drawings, it so happens that the winding in each clutch/brake system is only unidirectional so that neither system can be used in a bidirectional fashion and that is why two are required. If, for a particular purpose only a one way control of the entrance function is required, with no control of the exit function being needed, then only one clutch/brake and solenoid system is used for such entrance control.

There has been a common limitation in all conventional controlled actuation turnstiles and that is that when any pressure is exerted against the barrier of the turnstile or door, the turnstile will not unlock. In heavy traffic situations, particularly in the transit industry, this plays havoc with trying to move people efficiently and safely at the greatest speed through the turnstile. In other words, the person directly at the turnstile needs to back up in order to disengage the locking mechanism. With the present invention, the control head automatically releases no matter how much pressure is being applied to the barrier arms whether accidentally or on purpose.

A ten million cycle test of the inventive control system, which is the equivalent of 30 million admissions, was abandoned after it became evident that there was no appreciable wear on the mechanism for controlling the turnstile. In addition, an impact test, which is the equivalent of a 225 pound person traveling at a speed of 8 mph striking one of the barrier arms revealed no discernable wear damage or fatigue to the control mechanism. Finally, an impact test equivalent to a downward or vertical load dropped at least 20 times from a height of two feet also revealed no permanent deformation or damage to either the barrier arms or to the hub and control mechanism.

With reference now to the alternate embodiment of FIG. 13, the invention is there shown as utilizing a different type of locking member for securing the turnstile arms in place. For ease of illustration and appreciation of this alternative, like components are identified by like numerals with a double primed (") suffix and new components are identified by new numerals.

In this embodiment, the locking member comprises a slotted spring pin 250 which can have a C-shaped cross section with a pair of opposed arms 251. The arms 251 are intended to increase the strength of the spring pin 250. The pin 250 is housed in a suitable first column trough 46" of a pivot column 14". Extending into a groove 20" of the column 14" is a suitable turnstile arm 252 which is provided with a trough 254 that allows the spring pin, when correctly rotated, to lock the arm 252 against dislodgement from the pivot column 14'.

The spring can, if desired, be formed in an annealed condition from a flat metal to the profile illustrated which ends up with a semi-circular or C-shape similar to the rigid bar illustrated in FIG. 4. The metal is tempered to a Rockwell C hardness of 50 or 55 so that it will provide a spring-like locking quality to the system. This makes up for any shortcomings in the extrusion process or the stamping process for the turnstile arms 252. The spring pins can be relatively long, approximately 3½, feet so that they can lock a number of arms simultaneously.

A tool which can be used to rotate the spring pin can be simply a square bar 256, as is illustrated in FIG. 14. The bar, which can be made of metal, can be inserted inside the pin 250. When the pin is oriented as shown in FIG. 13 there will be a slight compression of the sides of the spring pin against the arm 252 and the pivot column 14'', respectively. This will lock the arm 252 in place in the column 14'' and obstruct the removal of the arm. The pin has the compressiveness to maintain a constant pressure on that portion of the arm which it contacts as well as the pivot column wall surface it contacts. This arrangement makes it possible to ship the turnstile in a flat container and allows the customer to assemble the turnstile arms 252 with the pivot column 14'' and lock the arms in place. Furthermore, this arrangement enables a customer to replace any arms which are damaged or need replacement in just a few minutes simply by disengaging the top frame and inserting and rotating the bar 256 to turn the spring pin 250 back into the free position. This allows any arms which need removal, for whatever purpose, to be removed.

The invention has now been described with reference to the preferred and alternate embodiments. Obviously, alterations and modifications will occur to others upon a reading and understanding of this specification. It is intended to include all such modifications and alterations insofar as they come within the scope of the appended claims or the equivalents thereof.

What is claimed is:

1. A revolving door construction comprising:

an elongated pivot column including a plurality of integrally formed first grooves extending longitudinally therealong at equidistantly spaced intervals therearound;

a plurality of barrier members, at least one of such members being associated with each first groove and arranged to extend radially outward of said first groove; and, a locking means concealably contained and interposed between a side wall of each first groove and a terminal end of each barrier member mountingly associated therewith for retaining said barrier member in said groove, said locking means comprising:

a second groove which extends longitudinally along said side wall of each first groove, and a locking bar extending in said second groove, said locking bar having a round side and a flat side and being selectively rotatable to wedgingly engage both a wall of said second groove and said terminal end of each barrier member.

2. The door construction of claim 1 wherein said plurality of barrier members each comprise extruded pivot column arms mountingly associated with each groove and arranged to extend radially outward of said groove, the pivot column arms associated with each groove being spaced apart from each other in a substantially aligned relationship for defining a barrier plane.

3. The door construction of claim 1 wherein said plurality of barrier members comprise planar panel members which extend substantially the full length of said first groove.

4. The door construction of claim 2 further comprising spacer members received in said first grooves between each two of said pivot column arms.

5. The door construction of claim 1 wherein said pivot column comprises:

a support body having a generally triangular cross-section and having a substantially central located multi-sided aperture extending longitudinally therethrough, said first grooves extending in said support body; and, a multi-sided pivot shaft adapted to extend through said body multi-sided aperture, said pivot shaft contacting a plurality of walls of said multi-sided aperture of said support body to rotate same.

6. The door construction of claim 1 further comprising a pivot control mechanism operatively associated with said pivot column for selectively controlling the rotation thereof, said mechanism including a cam having a continuous cam surface with a plurality of detents disposed at spaced intervals therealong for defining a plurality of pivot column home positions, a cam follower which is normally urged into engagement with said cam surface for generally biasing said pivot column to one of said home positions, and a means for determining a direction of allowable pivot column rotation.

7. The door construction of claim 6 wherein said cam follower comprises:

an outer cylinder;

an inner cylinder slidably held in said outer cylinder;

a ball held at a front end of said inner cylinder;

a compression spring extending in said inner and outer cylinders, said compression spring resiliently biasing said inner cylinder, and said ball away from a rear end of said outer cylinder; and, an adjusting means for adjusting the amount of compression exerted on said compression spring.

8. The door construction of claim 7 wherein said adjusting means comprises a set screw threadably engaging said outer cylinder.

9. The door construction of claim 6 wherein said means for determining a direction of allowable pivot column rotation comprises:

a pivot rod on which the pivot column rotates;

a hub section secured to said pivot rod;

a spring clutch assembly encircling said hub section for controlling a rotation of said pivot rod; and, a solenoid actuating mechanism operatively connected to said spring clutch assembly for selectively actuating same.

10. The door construction of claim 1 wherein said locking means further comprises a third groove which extends across each barrier member terminal portion parallel to said second groove, wherein said locking bar can be selectively rotated into said third groove.

11. The door construction of claim 1 wherein said locking bar comprises a rigid member.

12. The door construction of claim 1 wherein said locking bar comprises a resilient spring pin.

13. A turnstile construction adapted to facilitate selective passage between two separated areas, said turnstile comprising:

a plurality of elongated upstanding mounting columns spaced apart from each other to define a frame-like structure at some predetermined location between said areas;

closure means extending between at least a pair of said mounting columns;

an elongated upstanding pivot column spaced from said pair of mounting columns and journaled for selective rotation about its longitudinal axis, said pivot column having a plurality of longitudinal grooves disposed at spaced intervals therearound;

a plurality of pivot column arms associated with each pivot column groove and arranged to extend radially outward of said pivot column, those column arms associated with each groove being spaced apart from each other in a generally aligned relationship with each other over at least a portion of the groove length; and, a locking means received in each groove in a cooperative locking relationship with one end of the associated column arms, said locking means comprising an elongated locking member extending longitudinally in each of said longitudinal grooves, said locking member having a flat side and a round side and being selectively rotatable to wedgingly engage both a wall of said longitudinal groove and each of the associated column arms.

14. The turnstile construction of claim 13 wherein one of the other of said mounting columns is spaced from said closure means and said pivot column and includes a plurality of barrier arms extending radially outward therefrom at spaced intervals along at least a portion thereof generally toward said closure means, said barrier arms being spaced apart from each other to permit free passage of said pivot column arms therebetween when said pivot column is selectively rotated about its longitudinal axis and further including retaining means for holding said barrier arms in place in said other of said mounting columns.

15. The turnstile construction of claim 13 further including pivot column arm spacers received in said plurality of grooves for positioning the associated ones of said column arms in the desired generally aligned relationship with each other.

16. The turnstile construction of claim 13 further comprising:

a pivot control mechanism operatively associated with said pivot column for selectively controlling rotation thereof, said mechanism including a cam having a continuous cam surface with a plurality of detents disposed at spaced intervals therealong for defining a plurality of pivot column home positions, a cam follower normally urged into engagement with said cam surface for generally biasing said pivot column to one of said home positions and means for determining the general direction of allowable pivot column rotation; and, a locking means for selectively locking said turnstile to prevent rotation thereof.

17. The turnstile construction of claim 13 wherein said locking member comprises a rigid locking bar having a round side and a flat side, said locking bar also including a means for cooperating with a suitable associated tool in order to allow said locking bar to be rotated.

18. The turnstile construction of claim 13 wherein said locking member comprises a C-shaped spring pin which is adapted to be selectively rotated by an associated tool.

19. A rotary gate control assembly comprising:

a pivot rod on which the rotary gate is adapted to rotate;

a first hub section secured to said pivot rod;

a first spring clutch assembly encircling said first hub section for controlling a rotation of said pivot rod;

a first solenoid actuating mechanism operatively connected to said first spring clutch assembly for selectively actuating same;

a second hub section spaced from said first hub section; said second hub section being secured to said pivot rod;

a second spring clutch assembly encircling said second hub section; and, a second solenoid actuating mechanism operatively connected to said second spring clutch assembly, wherein said first spring clutch assembly controls a rotation of said pivot rod in a first direction and said second spring clutch assembly controls a rotation of said pivot rod in a second direction.

20. The control assembly of claim 19 wherein said first spring clutch assembly comprises:

a wrap spring encircling said hub section;

a release sleeve encircling said wrap spring and being operatively connected thereto; and, a collar arm extending away from said release sleeve, said collar arm being connected to said solenoid actuating mechanism.

21. The control assembly of claim 20 further comprising:

a cylindrical member located between said first and second hub sections wherein said wrap spring also encircles a portion of said cylindrical member; and, a plate fixedly secured to said cylindrical member, said plate extending in a direction substantially normal to said cylindrical member.

22. The control assembly of claim 19 wherein said solenoid actuating mechanism comprises:

a solenoid;

a first arm extending from said solenoid;

a second arm which is pivotably secured to a free end of said first arm, wherein said second arm is operatively connected to said first spring clutch assembly; and a spring member encircling said first arm for biasing said solenoid to one end position.

23. A jam-resistant rotary gate control assembly comprising:

a pivot rod on which the rotary gate is adapted to rotate;

a cam having a continuous cam surface with a plurality of detents disposed at spaced intervals therealong for defining a plurality of pivot rod home positions, said cam being secured to said pivot rod adjacent one end thereof;

a hub section secured to said pivot rod adjacent said cam;

a spring clutch assembly encircling said hub section for controlling a rotation of said pivot rod, said spring clutch assembly comprising a release collar having an arm extending away therefrom; and a solenoid actuating mechanism operatively connected to said release collar arm for selectively actuating same, wherein said pivot rod can be released by actuation of said spring clutch assembly regardless of how much pressure is being applied to the rotary gate.

24. The control assembly of claim 23 further comprising:

a cam follower which is normally urged into engagement with said cam surface for generally biasing said pivot column to one of said home positions.

25. The control assembly of claim 24 wherein said cam follower comprises:

an outer cylinder;

an inner cylinder slidably held in said outer cylinder;

a ball held at a front end of said inner cylinder;

a compression spring extending in said inner and outer cylinders, said compression spring resiliently biasing said inner cylinder, and said ball away from a rear end of said outer cylinder; and, an adjusting means for adjusting the amount of compression exerted on said compression spring.

26. The control assembly of claim 25 wherein said adjusting means comprises a set screw threadably engaging said outer cylinder.

27. The control assembly of claim 23 wherein said solenoid actuating mechanism comprises:

a solenoid device;

a first arm extending away from said solenoid device; and, a second arm pivotably secured at one end to said first arm, wherein said second arm is pivotably secured at its second end to said release collar arm.

28. The control assembly of claim 23 wherein said spring clutch assembly further comprises a wrap spring encircling said hub section and wherein one end of said wrap spring is held in operative contact with said release collar.

* * * * *